US008620203B2

(12) United States Patent
Karasawa et al.

(10) Patent No.: US 8,620,203 B2
(45) Date of Patent: Dec. 31, 2013

(54) WASTE TONER CONTAINER AND IMAGE FORMING APPARATUS INCORPORATING SAME

(75) Inventors: Shinya Karasawa, Kanagawa (JP); Ken Amemiya, Tokyo (JP); Michiya Okamoto, Kanagawa (JP); Takuma Iwasaki, Kanagawa (JP); Yuta Azeyanagi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 320 days.

(21) Appl. No.: 13/067,227

(22) Filed: May 18, 2011

(65) Prior Publication Data

US 2012/0014728 A1 Jan. 19, 2012

(30) Foreign Application Priority Data

Jul. 14, 2010 (JP) ..... 2010-159363
Dec. 19, 2010 (JP) ..... 2010-282483

(51) Int. Cl.
*G03G 21/12* (2006.01)

(52) U.S. Cl.
USPC ..... 399/360

(58) Field of Classification Search
USPC ..... 399/35, 120, 123, 358, 360, 344
See application file for complete search history.

(56) References Cited

U.S. PATENT DOCUMENTS 6,937,838 B2 * 8/2005 Ishii et al. ..... 399/358
7,103,308 B2 * 9/2006 Wakana ..... 399/358
7,634,221 B2 * 12/2009 Kudo ..... 399/360
7,890,045 B2 * 2/2011 Wasai ..... 399/360
7,904,014 B2 * 3/2011 Umehara et al. ..... 399/358
2003/0219264 A1 11/2003 Serizawa
2004/0052560 A1 3/2004 Ishii et al.
2004/0096251 A1 5/2004 Ahn et al.
2008/0226333 A1 9/2008 Ono et al.
2009/0097879 A1 4/2009 Nagashima et al.
2009/0196666 A1 8/2009 Wasai (Continued)

FOREIGN PATENT DOCUMENTS

CN 1459678 12/2003
CN 1493932 5/2004

(Continued)

OTHER PUBLICATIONS

Abstract of JP 2005010751 published Jan. 13, 2005.

(Continued)

*Primary Examiner* — Robert Beatty
(74) *Attorney, Agent, or Firm* — Harness, Dickey & Pierce P.L.C.

(57) ABSTRACT

A waste toner container used in an image forming apparatus includes a waste toner reservoir extending in a depth direction of the image forming apparatus for containing waste toner removed from an image bearer, an inlet portion provided above the waste toner reservoir, including a waste toner inlet to receive the waste toner flowing to the waste toner reservoir, a first agitator provided in the waste toner reservoir, to transport the waste toner therein in the depth direction, a rotary member provided in the inlet portion, including a rotary shaft extending in a width direction perpendicular to the depth direction, and a drive transmission unit provided outside the waste toner reservoir, to transmit a drive force from the rotary member provided in the inlet portion to the first agitator provided in the waste toner reservoir and to drive the first agitator in conjunction with rotation of the rotary member.

19 Claims, 6 Drawing Sheets

(56) References Cited

U.S. PATENT DOCUMENTS

| | | | | |
|---|---|---|---|---|
| 2009/0290893 | A1 | 11/2009 | Ogiso et al. | |
| 2010/0080600 | A1 | 4/2010 | Okamoto et al. | |
| 2011/0052225 | A1 | 3/2011 | Honjoh et al. | |
| 2012/0237230 | A1 * | 9/2012 | Karasawa et al. | 399/35 |

FOREIGN PATENT DOCUMENTS

| | | | | |
|---|---|---|---|---|
| CN | 1493942 | | | 5/2004 |
| JP | 05303313 | | | 11/1993 |
| JP | 09-325662 | | | 12/1997 |
| JP | 2000-056648 | | | 2/2000 |
| JP | 2002108035 | A | * | 4/2002 |
| JP | 3700621 | A | | 2/2003 |
| JP | 4286704 | | | 1/2005 |
| JP | 2007139905 | A | | 6/2007 |
| JP | 2007156253 | A | | 6/2007 |
| JP | 2008134398 | A | * | 6/2008 |

OTHER PUBLICATIONS

Abstract of JP 2003043886 published Feb. 14, 2003.
Chinese Office dated Jan. 4, 2013 issued in corresponding Chinese Application No. 201110193860.8.
Chinese Office Action dated Jul. 19, 2013 for corresponding Chinese Application No. 201110193860.8.

* cited by examiner

WASTE TONER CONTAINER AND IMAGE FORMING APPARATUS INCORPORATING SAME

CROSS-REFERENCE TO RELATED APPLICATIONS

This patent specification is based on and claims priority from Japanese Patent Application Nos. 2010-159363, filed on Jul. 14, 2010, and 2010-282483, filed on Dec. 19, 2010 in the Japan Patent Office, which are hereby incorporated by reference herein in their entirety.

BACKGROUND OF THE INVENTION

1. Field of the Invention

The present invention generally relates to an image forming apparatus such as a copier, a printer, a facsimile machine, or a multifunction machine capable of at least two of these functions; and a waste toner container used therein.

2. Description of the Background Art

Generally, image forming apparatuses such as copiers and printers include an image bearer, such as a drum-shaped or belt-shaped photoreceptor and drum-shaped or belt-shaped intermediate transfer member, and a cleaning unit to remove any toner remaining on the image bearer after image transfer. The toner removed from the image bearer (i.e., waste toner) is collected in a waste toner container.

Being filled to capacity (or close to the capacity) with the waste toner, the waste toner container is removed from the main body of the image forming apparatus, and an empty waste toner container is set in the apparatus instead.

For example, certain conventional approaches propose providing a waste toner conveyance member such as a paddle in a waste toner reservoir in the waste toner container to level the waste toner in the waste toner reservoir. To transmit a drive force to the waste toner conveyance member, a cam mechanism (i.e., drive transmission unit) is provided in the waste toner reservoir.

The above-described approaches, however, have several drawbacks. For example, because the cam mechanism (drive transmission unit) is provided inside the waste toner reservoir to transport the waste toner, it is possible that the waste toner gets into the cam mechanism, causing the waste toner conveyance member to malfunction. When the waste toner conveyance member does not function properly, the waste toner cannot be leveled in the waste toner reservoir of the waste toner container and inaccurately indicating that it is filled to capacity. As a result, replacement cycle of the waste toner container is shortened.

In particular, recently, to extend the replacement cycle of the waste toner container, large-capacity waste toner containers are widely used, making full use of the space inside the apparatus except functional areas such as an image forming unit, a sheet feeder, a fixing device, and a sheet conveyance unit. Therefore, it is wasteful if the large-capacity waste toner container is not used to its capacity.

Therefore, the inventors of the present invention recognize that there is a need for a waste toner container capable of containing waste toner to its capacity uniformly without causing the waste toner conveyance member and an image forming apparatus including same to malfunction, which known approaches fail to do.

SUMMARY OF THE INVENTION

In view of the foregoing, one illustrative embodiment of the present invention provides a waste toner container used in an image forming apparatus. The waste toner container includes a waste toner reservoir for containing waste toner removed from an image bearer, an inlet portion provided above the waste toner reservoir, a first agitator provided in the waste toner reservoir, a rotary member provided in the inlet portion, and a drive transmission unit provided outside the waste toner reservoir. The waste toner reservoir extends in a depth direction of the image forming apparatus, and the first agitator transports the waste toner accumulating in the waste toner reservoir in the depth direction. At least one waste toner inlet is formed in the inlet portion to receive the waste toner flowing to the waste toner reservoir. The rotary member includes a rotary shaft extending in a width direction perpendicular to the depth direction. The drive transmission unit transmits a drive force from the rotary member, provided in the inlet portion, to the first agitator, provided in the waste toner reservoir, and drives the first agitator in conjunction with rotation of the rotary member.

In another illustrative embodiment of the present invention, an image forming apparatus includes an image forming unit to form a toner image on the image bearer, a cleaning unit to remove untransferred toner as waste toner form the image bearer after the toner image is transferred therefrom, and the waste toner container described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
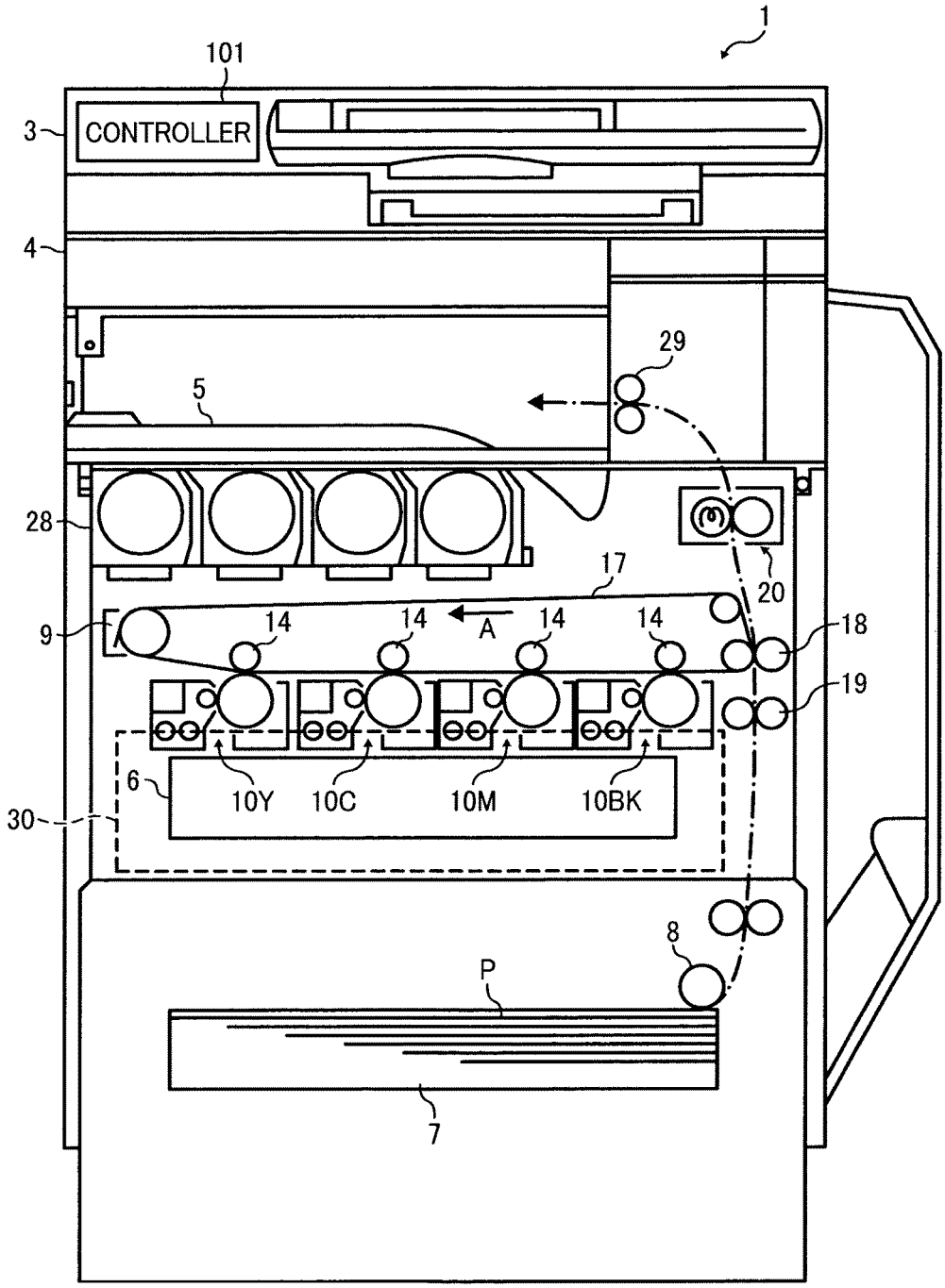
FIG. 1 is a schematic diagram illustrating a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that the term "process cartridge" used in this specification means an integrated unit including an image bearer and at least one of a charging unit, a development device, and a cleaning unit housed in a common unit casing and is designed to be removably installed in a main body of the image forming apparatus.

Referring now to the drawings, wherein like reference numerals designate identical or corresponding parts throughout the several views thereof, and particularly to FIG. 1, a multicolor image forming apparatus according to an illustrative embodiment of the present invention is described. It is to be noted that the subscripts Y, M, C, and BK attached to the end of each reference numeral indicate only that components indicated thereby are used for forming yellow, magenta, cyan, and black images, respectively, and hereinafter may be omitted when color discrimination is not necessary.

Referring to FIG. 1, a configuration and operation of an image forming apparatus 1 according to a first embodiment is described below.

The image forming apparatus 1 according to the present embodiment is a tandem multicolor image forming apparatus and includes multiple process cartridges 10Y, 10M, 10C, and 10BK, serving as image forming units, that are arranged in parallel to each other, facing an intermediate transfer belt 17.

In FIG. 1, reference characters 3 represents a document feeder to send an original document to a document reading unit 4 that reads image data of the original document, 6 represents a writing unit (exposure unit) to emit laser beams L (shown in FIG. 2) according to the image data, 7 represents a sheet feeder for containing sheets P of recording media, 10Y, 10M, 10C, and 10BK represent the process cartridges for respective colors (yellow, magenta, cyan, and black), 17 represents the intermediate transfer belt, serving as an image bearer on which multiple single-color toner images are superimposed one on another, 18 represents a secondary-transfer roller to transfer the superimposed toner image from the intermediate transfer belt 17 onto the sheet P, 20 represents a fixing device to fix the toner image on the sheet P, 28 represents toner containers from which respective color toners are supplied to development devices 13 (shown in FIG. 2) in the respective process cartridges 10Y, 10M, 10C, and 10BK, and 30 represents a waste toner container for containing waste toner.

Figure 2:
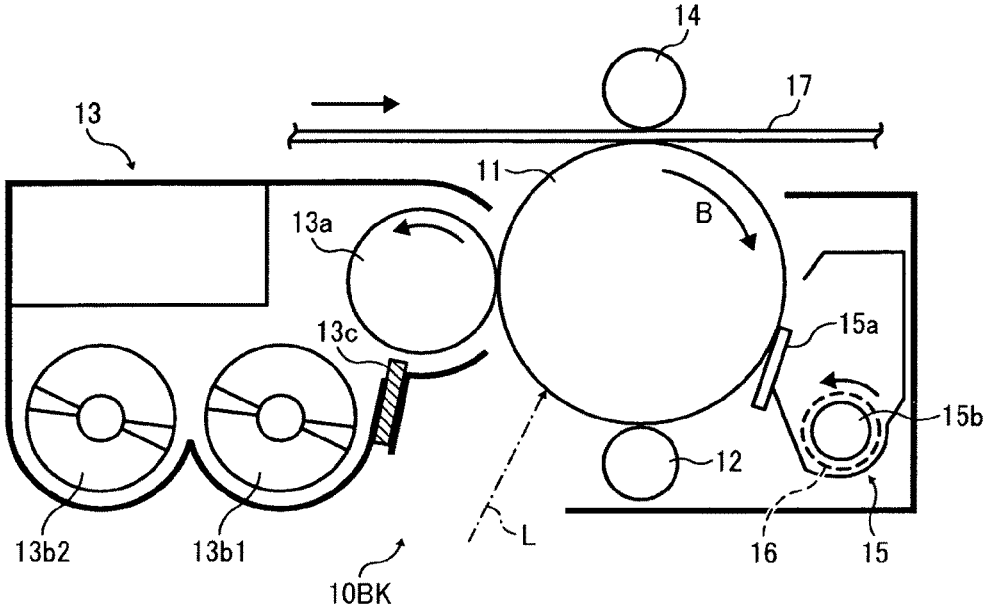
FIG. 2 is a schematic end-on axial view of an image forming unit included in the image forming apparatus shown in FIG. 1.

Referring to FIG. 2, each of the process cartridges 10Y, 10M, 10C, and 10BK includes a photoreceptor drum 11 serving as an image bearer, a charging unit 12, the development device 13, and a cleaning unit 15, which are housed in a common unit casing. Each process cartridge 10 is replaced with a new one when its operational life expires.

In the process cartridges 10Y, 10M, 10C, and 10BK, yellow, magenta, cyan, and black toner images are formed on the respective photoreceptor drums 11.

Operations of the image forming apparatus 1 shown in FIG. 1 to form multicolor images are described below.

Conveyance rollers provided in the document feeder 3 transport original documents set on a document table onto an exposure glass (contact glass) of the document reading unit 4. Then, the document reading unit 4 reads image data of the original document set on the exposure glass optically.

More specifically, the document reading unit 4 scans the image of the original document with light emitted from an illumination lamp, not shown. The light reflected from the surface of the original document is imaged on a color sensor via mirrors and lenses, not shown. The color sensor reads the multicolor image data of the original document for each decomposed colors of red, green, and blue (RGB) and converts the image data into electrical image signals. Further, the image signals are transmitted to an image processor (not shown) that performs image processing (e.g., color conversion, color calibration, and spatial frequency adjustment) on the image signals, and thus image data of yellow, magenta, cyan, and black is obtained.

The yellow, magenta, cyan, and black single-color image data is then transmitted to the writing unit 6, and the writing unit 6 directs the laser beams L (exposure light) corresponding to the single-color image data to the respective photoreceptor drums 11 of the process cartridges 10Y, 10M, 10C, and 10BK.

Meanwhile, the four photoreceptor drums 11 rotate clockwise in FIG. 2 as indicated by arrow B. As shown in FIG. 2, a surface of the photoreceptor drum 11 is charged uniformly at a position facing the charging unit 12 (e.g., a charging roller) by it (charging process). Thus, the surface of the photoreceptor drum 11 is charged to a predetermined electrical potential.

When the surfaces of the photoreceptor drums 11 reach positions to receive the respective laser beams L, the writing unit 6 directs the laser beams L according to the respective color image date, emitted from the light sources, to the respective photoreceptor drums 11. Although not shown in the drawings, the laser beams L are deflected by a polygonal mirror and pass through multiple lenses. Then, the laser beams L pass through different optical paths for yellow, magenta, cyan, and black (exposure process).

The laser beam L corresponding to the yellow component is directed to the photoreceptor drum 11 in the process cartridge 10Y that is the first from the left in FIG. 1 among the four process cartridges 10. The polygon mirror, not shown, that rotates at high velocity deflects the laser beam L for yellow in a direction of a rotary axis of the photoreceptor drum 11 (main scanning direction) so that the laser beam L scans the surface of the photoreceptor drum 11. Thus, an electrostatic latent image for yellow is formed on the photoreceptor drum 11 charged by the charging unit 12.

The laser beam L corresponding to the cyan component is directed to the surface of the photoreceptor drum 11 in the process cartridge 10C that is the second from the left in FIG. 1, thus forming an electrostatic latent image for cyan thereon. Similarly, the laser beam L corresponding to the magenta component is directed to the surface of the photoreceptor drum 11 in the process cartridge 10M that is the third from the left in FIG. 1, thus forming an electrostatic latent image for magenta thereon. The laser beam L corresponding to the black component is directed to the surface of the photoreceptor drum 11 in the process cartridge 10BK that is the fourth from the left in FIG. 1 (extreme upstream in the direction indicated by arrow A shown in FIG. 1, in which the intermediate transfer belt 17 rotates), thus forming an electrostatic latent image for black thereon.

Then, each photoreceptor drum 11 reaches a position facing the development device 13 shown in FIG. 2, and the development device 13 supplies toner of the corresponding color to the photoreceptor drum 11. Thus, the latent images on the respective photoreceptor drums 11 are developed into different single-color toner images (development process).

Subsequently, the surface of the photoreceptor drum 11 reaches a position facing the intermediate transfer belt 17, serving as the image bearer as well as an intermediate transfer member. Primary-transfer rollers 14 are provided in contact with an inner circumferential surface of the intermediate transfer belt 17 at the positions where the respective photoreceptor drums 11 face the intermediate transfer belt 17. The toner images formed on the respective photoreceptor drums 11 are sequentially transferred and superimposed one on another on the intermediate transfer belt 17 by the primary transfer rollers 14, forming a multicolor toner image thereon (primary transfer process).

After the primary transfer process, the surface of each photoreceptor drum 11 reaches a position facing the cleaning unit 15, which collects any toner remaining on the photoreceptor drum 11, which is hereinafter referred to as "untransferred toner" (cleaning process).

Additionally, the surface of each photoreceptor drum 11 passes through a discharge device, not shown, and thus a sequence of image forming processes performed on each photoreceptor drum 11 is completed.

Meanwhile, the surface of the intermediate transfer belt 17 carrying the superimposed toner image moves in the direction indicated by arrow A and reaches the position facing the secondary-transfer roller 18. The secondary-transfer roller 18 transfers the multicolor toner image from the intermediate transfer belt 17 to the sheet P (secondary-transfer process).

Further, the surface of the intermediate transfer belt 17 reaches a position facing a belt cleaning unit 9. The belt cleaning unit 9 collects any untransferred toner remaining on the intermediate transfer belt 17, and thus a sequence of transfer processes performed on the intermediate transfer belt 17 is completed.

The sheet P is transported from the sheet feeder 7 to the secondary-transfer roller 18 via a sheet guide, a pair of registration rollers 19, and the like.

More specifically, a feed roller 8 sends out the sheet P from a sheet cassette of the sheet feeder 7, and the sheet P is then guided by the sheet guide, not shown, to the registration rollers 19. The registration rollers 19 forward the sheet P to the secondary-transfer nip, timed to coincide with arrival of the multicolor toner image formed on the intermediate transfer belt 17.

Then, the sheet P carrying the multicolor image is transported to a fixing device 20. The fixing device 20 includes a fixing roller and a pressure roller pressing against each other, forming a nip therebetween, in which the multicolor image is fixed on the sheet P.

After the fixing process, a pair of discharge rollers 29 discharges the sheet P as an output image to a stack portion 5, provided outside the image forming apparatus 1. Thus, a sequence of image forming processes is completed.

Next, image forming units are described in further detail below with reference to FIG. 2.

FIG. 2 is an end-on axial view of the process cartridge 10BK for black. Other three process cartridges 10Y, 10M, and 10C have similar configuration to that of the process cartridge 10BK except the color of the toner used therein, and thus drawings and descriptions thereof are omitted.

As shown in FIG. 2, the process cartridge 10BK includes the photoreceptor drum 11 serving as the image bearer, the charging unit 12 to charge the surface of the photoreceptor drum 11, the development device 13 to develop the latent image formed on the photoreceptor drum 11, and the cleaning unit 15 to clean the photoreceptor drum 11, housed in the common unit casing.

The photoreceptor drum 11 used in the present embodiment is an organic photoreceptor charged to a negative polarity and includes a photosensitive layer formed on a drum-shaped electroconductive support member. For example, the photoreceptor drum 11 is multilayered, and a base coat serving as an insulation layer, the photosensitive layer, and a protection layer (surface layer) are formed sequentially on the support member. The photosensitive layer includes a charge generation layer and a charge transport layer.

The charging unit 12 may be a charging roller that includes an electroconductive metal core and an elastic layer of moderate resistivity overlying an outer circumference of the metal core. Receiving a predetermined voltage from a power source, the charging unit 12 uniformly charges the surface of the photoreceptor drum 11 facing the charging unit 12.

The development device 13 includes a development roller 13*a* disposed facing the photoreceptor drum 11, a first conveyance screw 13*b*1 disposed facing the development roller 13*a*, a second conveyance screw 13*b*2 disposed facing the first conveyance screw 13*b*1 via a partition, and a doctor blade 13*c* disposed facing the development roller 13*a*. The development roller 13*a* includes a magnet roller or multiple magnets fixed in position relative to the casing of the development device 13, and a sleeve that rotates around the magnets. The magnets generate multiple magnetic poles around the circumferential surface of the development roller 13*a*, and thus developer (i.e., toner) is carried on the circumferential surface of the development roller 13*a*.

The development device 13 contains two-component developer consisting essentially of carrier (carrier particles) and toner (toner particles). The toner used in the present embodiment has a smaller particle diameter and is substantially spherical in shape.

More specifically, the toner has a circularity not smaller than 0.92. The circularity herein is a mean circularity measured by a flow-type particle image analyzer FPIA-2000 from SYSMEX CORPORATION. More specifically, as a dispersant, 0.1 ml to 0.5 ml of surfactant (preferably, alkylbenzene sulfonate) is put in 100 ml to 150 ml of water from which impure solid materials are previously removed, and 0.1 g to 0.5 g of the sample (toner) is added to the mixture. Then, the mixture including the toner is dispersed with an ultrasonic disperser for 1 to 3 minutes to prepare a dispersion liquid having a concentration of from 3,000 to 10,000 pieces/μl, and the toner shape and distribution are measured with the above-mentioned measurer.

The toner in the present embodiment has a first shape factor SF-1 and a second shape factor SF-2 both within a range of 100 to 180, for example. Additionally, the toner in the present embodiment has a volume-average particle diameter (Dv) of from 3 μm to 7 μm, and the ratio of the volume average particle diameter (Dv) to the number average particle diameter (Dn) is within a range of from 1.05 to 1.40 (Dv/Dn), for example.

Further, the ratio of the long axis (r1) to the short axis (r2) of the toner (r1/r2) is within a range from 0.5 to 1.0, the ratio of thickness (r3) to the short axis (r2) of the toner (r3/r2) is within a range from 0.7 to 1.0, wherein r1≥r2≥r3.

Such substantially spherical toner having a smaller particle diameter can be produced as follows: Polyester prepolymer having a functional group including a nitrogen atom; polyester; a colorant; and a release agent are dispersed in an organic solvent, thus producing a toner material solution. Then, the toner is produced through at least one of cross-linking and elongation reaction of the toner material solution in an aqueous medium that includes fine resin particles.

Referring to FIG. 2, the cleaning unit 15 includes a cleaning blade 15*a* disposed in contact with the photoreceptor drum 11, a conveyance tube 16 in which a conveyance coil 15*b* is provided, and the like. The untransferred toner removed from the photoreceptor drum 11 and collected in the cleaning unit 15 is transported as waste toner to the waste toner container 30 (shown in FIG. 3) through the conveyance tube 16. The cleaning blade 15*a* is formed of rubber such as urethane rubber, disposed at a predetermined angle to the surface of the photoreceptor drum 11 and pressed against the surface of the photoreceptor drum 11 with a predetermined pressure. With this arrangement, any substance such as toner and dust adhering to the surface of the photoreceptor drum 11 can be removed mechanically and is collected in the cleaning unit 15. Then, the untransferred toner collected in the cleaning unit 15 is transported through the conveyance tube 16 in which the conveyance coil 15*b* is provided and collected in the waste toner container 30 as waste toner.

Similarly, the belt cleaning unit 9 shown in FIG. 1 includes a cleaning blade disposed in contact with the intermediate transfer belt 17, and a conveyance tube 16 in which a conveyance coil is provided, and the like. The untransferred toner removed from the intermediate transfer belt 17 and collected in the belt cleaning unit 9 is transported as waste toner to the waste toner container 30 (shown in FIG. 3) through the conveyance tube 16. Then, the untransferred toner collected in the belt cleaning unit 9 is transported through the conveyance tube 16*a* in which the conveyance coil 15*b* is provided and collected in the waste toner container 30 as waste toner. A configuration and operation of the waste toner container 30 are described in further detail later.

It is to be noted that, although the substances adhering to the photoreceptor drum 11 or the intermediate transfer belt 17 include paper dust resulting from the sheet P, additives to the toner, substances generated on the photoreceptor drum 11 while the charging roller 12 discharges the photoreceptor drum 11 (hereinafter "discharge product"), and the like in addition to the untransferred toner, these substances are collectively referred to as "untransferred toner" in this specification.

The image forming processes are described in further detail below with reference to FIG. 2.

The development roller 13*a* rotates counterclockwise in FIG. 2 as indicated by an arrow shown in FIG. 2. In the development device 13, as the first and second conveyance screws 13*b*1 and 13*b*2, arranged via the partition, rotate, the developer is circulated in the longitudinal direction of the development device 13, which is perpendicular to the surface of the paper on which FIG. 2 is drawn, being mixed with fresh toner supplied from the toner container 28 by a toner supply unit.

Thus, the toner is electrically charged through friction with the carrier and adsorbed to the carrier. Then, the toner is carried on the development roller 13*a* together with the carrier. When the developer reaches a position facing the doctor blade 13*c* as the development roller 13*a* rotates, the amount of the developer on the development roller 13*a* is adjusted to a suitable amount by the doctor blade 13*c*, after which the developer is transported to a development area facing the photoreceptor drum 11.

In the development area, the toner in the developer adheres to the electrostatic latent image formed on the photoreceptor drum 11. More specifically, the electrical potential in an image area to which the laser beam L is directed to form the latent image (exposure potential) is different from that of a development bias applied to the development roller 13*a* (development potential), and the difference in electrical potential generates an electrical field. The toner is attracted to the latent image by the electrical field, thus forming a toner image.

Subsequently, most of the toner caused to adhere to the photoreceptor drum 11 in the development process is transferred to the intermediate transfer belt 17, and the untransferred toner remaining on the surface of the photoreceptor drum 11 is collected by the cleaning blade 15*a* in the cleaning unit 15.

Although not shown, the toner supply unit provided in the main body of the image forming apparatus 1 includes the replaceable bottle-shaped toner containers 28 and a toner hopper. The toner hopper holds and drives the toner containers 28, and supplies fresh toner to the development devices 13. In the present embodiment, each toner container 28 contains yellow, magenta, cyan, or black toner. Additionally, a spiral-shaped protrusion is formed on an inner circumferential surface of the toner container (toner bottle) 28.

The fresh toner contained in the toner container 28 is supplied through a toner supply inlet to the development device 13 as the toner therein is consumed. The consumption of the toner in the development device 13 is detected either directly or indirectly using a reflective photosensor positioned facing the photoreceptor drum 11 and a magnetic sensor provided beneath the second conveyance screw 13*b*2.

Next, the configuration and operation of the waste toner container 30 according to the first embodiment are described in further detail below.

Figure 3:
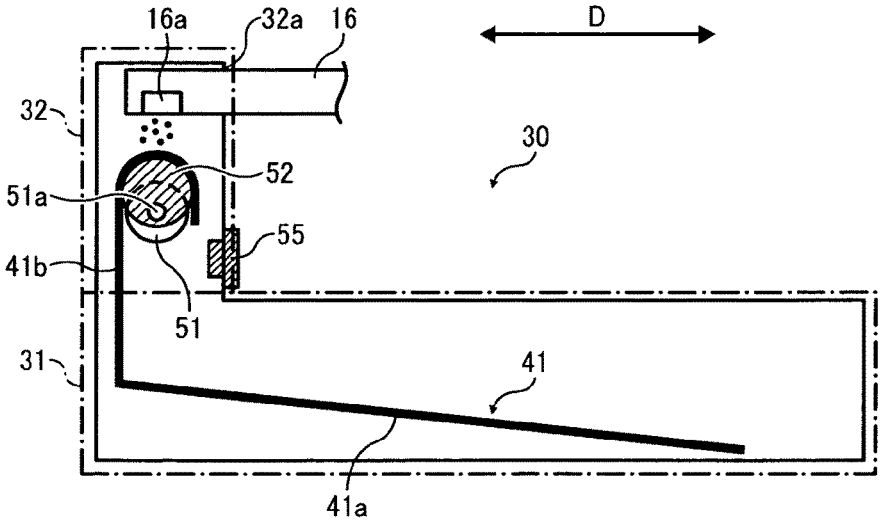
FIG. 3 is a cross-sectional view of a waste toner container along a depth direction.
Figure 4A:
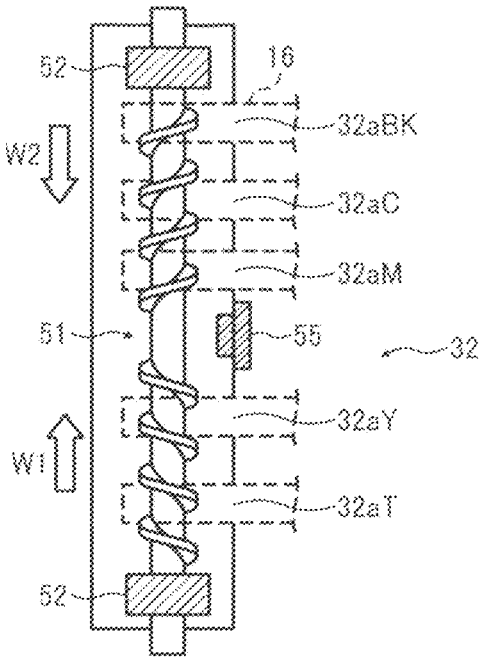
FIGS. 4A and 4B are respectively top views of a waste toner inlet portion and a waste toner reservoir of the waste toner container shown in FIG. 3.
Figure 4B:
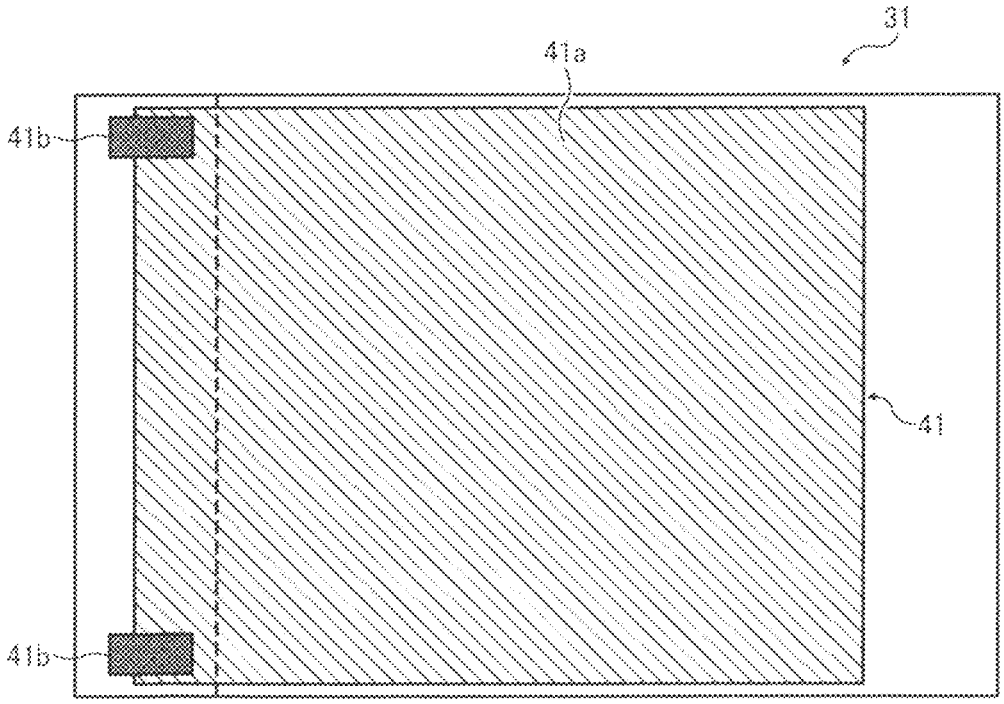
Figure 5:
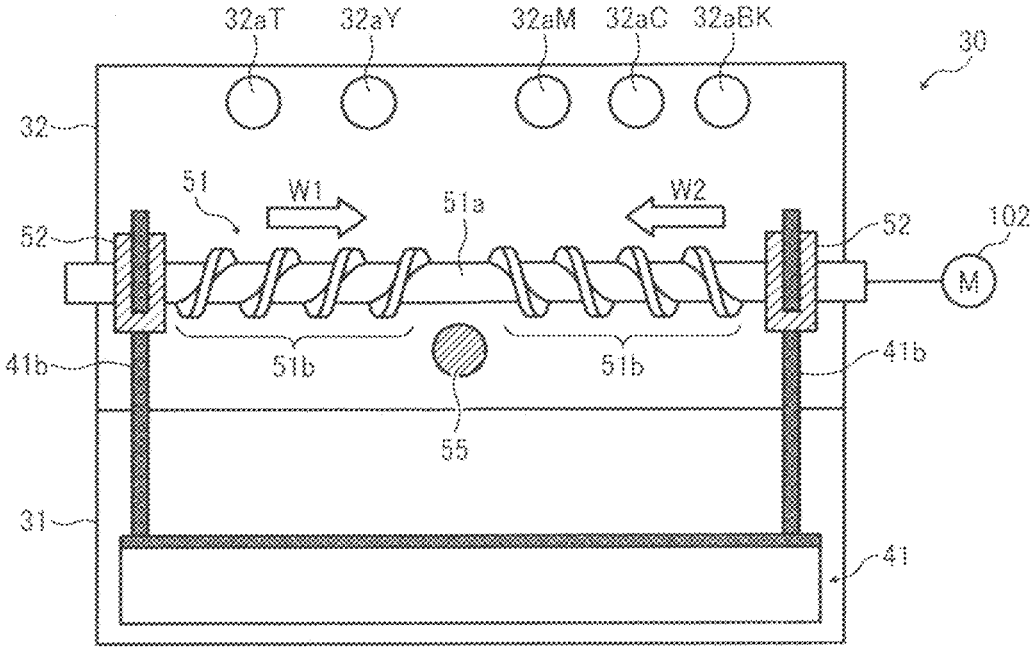
FIG. 5 is a cross-sectional view of the waste toner container along a width direction.

Referring to FIGS. 3 through 5, the waste toner container 30 includes a waste toner inlet portion 32 and a waste toner reservoir 31. The waste toner flowing from the belt cleaning unit 9 and the cleaning unit 15 is received by the waste toner inlet portion 32 and is stored in the waste toner reservoir 31.

The waste toner reservoir 31 is shaped like a substantially rectangular box extending in a depth direction of the waste toner container 30 or the main body of the apparatus indicated by arrow D, which is the lateral direction in FIGS. 3 and 4B and perpendicular to the surface of the paper on which FIG. 1 is drawn. Inside the waste toner reservoir 31, a pushing member 41 serving as a first agitator is provided.

The waste toner inlet portion 32 is provided above the waste toner reservoir 31, projecting from the waste toner reservoir 31. A rotary conveyance screw 51 serving as a rotary member is provided inside the waste toner inlet portion 32. The waste toner inlet portion 32 is shorter than the waste toner reservoir 31 in the depth direction. It is to be noted that, in FIG. 3, reference character 52 represents a cam, 51*a* represents a rotary shaft of the conveyance screw 51, 41*a* represents a planar portion of the pushing member 41, and 41*b* represents arms of the pushing member 41. No partition is provided on the boundary between the waste toner inlet portion 32 and the waste toner reservoir 31. Additionally, referring to FIGS. 4A and 5, five inlets 32*a*Y, 32*a*M, 32*a*C, 32*a*BK, and 32*a*T are formed in the waste toner inlet portion 32 through which the waste toner from the cleaning unit 9 and belt cleaning unit 15 flows into the waste toner inlet portion 32. It is to be noted that, in FIG. 3, for simplicity the subscripts Y, M, C, and BK to "32*a*" are omitted. The five inlets 32*a* are formed in an upper portion of the waste toner inlet portion 32, and the conveyance tubes 16 are connected to the inlets 32*a*, respectively. Additionally, the waste toner inlet portion 32 includes a waste toner detector 55 to detect whether the waste toner container 30 is filled to capacity with waste toner. More specifically, the waste toner detector 55 detects whether a predetermined amount of waste toner has accumulated in the waste toner inlet portion 32.

The untransferred toner discharged from the cleaning units 15 of the four process cartridges 10 and that discharged from the belt cleaning unit 9 are collected in the waste toner container 30 configured as described above. The waste toner reservoir 31 can contain a relatively large amount of waste toner, and the waste toner inlet portion 32 can contain additional amount of waste toner.

Referring to FIG. 5, the untransferred black toner collected by the cleaning unit 15 of the process cartridge 10BK flows into the waste toner inlet portion 32 from the inlet 32*a*BK, which is the first from the right in FIG. 5 among the five inlets 32*a* arranged in the waste toner inlet portion 32 in a width direction indicated by arrows W1 and W2, perpendicular to the depth direction. An end portion of the conveyance tube 16 connected to the cleaning unit 15 for black is inserted in the inlet 32*a*BK for black. In this state, the black waste toner is discharged from an outlet 16*a* (shown in FIG. 3) formed in the conveyance tube 16 to the waste toner inlet portion 32.

Similarly, the untransferred cyan toner collected by the cleaning unit 15 of the process cartridge 10C flows into the waste toner inlet portion 32 from the inlet 32*a*C, which is the second inlet 32*a* from the right in FIG. 5 in the width direction indicated by arrows W1 and W2. An end portion of the conveyance tube 16 connected to the cleaning unit 15 for cyan is inserted in the inlet 32*a*C for cyan. In this state, the cyan waste toner is discharged from an outlet 16*a* (shown in FIG. 3) formed in the conveyance tube 16 to the waste toner inlet portion 32.

Similarly, the untransferred magenta toner collected by the cleaning unit 15 of the process cartridge 10M flows into the waste toner inlet portion 32 from the inlet 32*a*M, which is the third inlet 32*a* from the right in FIG. 5. An end portion of the conveyance tube 16 connected to the cleaning unit 15 for magenta is inserted in the inlet 32*a*M for magenta. In this state, the magenta waste toner is discharged from an outlet 16*a* (shown in FIG. 3) formed in the conveyance tube 16 to the waste toner inlet portion 32.

Similarly, the untransferred yellow toner collected by the cleaning unit 15 of the process cartridge 10Y flows into the waste toner inlet portion 32 from the inlet 32*a*Y, which is the fourth inlet 32*a* from the right in FIG. 5. An end portion of the conveyance tube 16 connected to the cleaning unit 15 for yellow is inserted in the inlet 32*a*Y for yellow. In this state, the yellow waste toner is discharged from an outlet 16*a* (shown in FIG. 3) formed in the conveyance tube 16 to the waste toner inlet portion 32.

Similarly, the untransferred toner collected by the belt cleaning unit 9 flows into the waste toner inlet portion 32 from the inlet 32*a*T, which is the first inlet 32*a* from the left in FIG. 5. An end portion of the conveyance tube 16 connected to the belt cleaning unit 9 is inserted in the inlet 32*a*T. In this state, the waste toner is discharged from an outlet 16*a* (shown in FIG. 3) formed in the conveyance tube 16 to the waste toner inlet portion 32.

Figure 6:
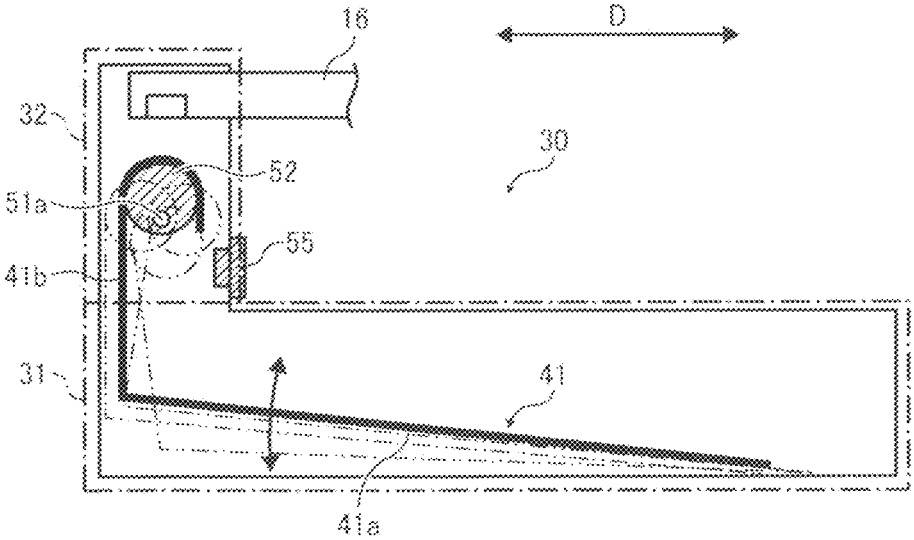
FIG. 6 illustrates movement of a first agitator provided in the waste toner reservoir.

The waste toner (untransferred toner) flowing from the inlets 32*a*Y, 32*a*M, 32*a*C, 32*a*BK, and 32*a*T falls under its own weight from the waste toner inlet portion 32 and accumulates in the waste toner reservoir 31 positioned beneath the waste toner inlet portion 32. The pushing member 41, serving as the first agitator, includes the planar portion 41*a* that is swingable laterally and vertically. The pushing member 41 pushes the accumulating waste toner to a distal side in the depth direction of the waste toner container 30 indicated by arrow D, that is, to the right in FIG. 3. An operational area of the planar portion 41*a* is indicated by broken lines shown in FIG. 6. When the entire waste toner reservoir 31 is filled to capacity or close to capacity with the waste toner, the waste toner flowing from the inlets 32*a*Y, 32*a*M, 32*a*C, 32*a*BK, and 32*a*T then accumulates in the waste toner inlet portion 32. When the waste toner reaches close to the height of the conveyance screw 51 (rotary member), the conveyance screw 51 transports the waste toner in the width direction as indicated by arrows W1 and W2 shown in FIGS. 4A and 5, which is perpendicular to the surface of the paper on which FIG. 3 is drawn, leveling the waste toner. When the waste toner detector 55 detects that the amount predetermined amount of waste toner has accumulated in the waste toner inlet portion 32, a controller 101 stops conveyance of the waste toner to the waste toner container 30 and causes a display provided in the main body of the image forming apparatus 1 to report that state. Then, recognizing that the waste toner container 30 is filled to capacity with the waste toner, users or service persons can replace the waste toner container 30.

It is to be noted that, to remove the waste toner container 30 from the main body, the user or service person opens a cover of the main body and moves the waste toner container 30 to the left in FIG. 3 (to the front side of the paper on which FIG. 1 is drawn). Then, the user or service person installs a new (empty) waste toner container 30 in the main body to the right in FIG. 3 (to the back side of paper on which FIG. 1 is drawn) with the cover of the main body opened.

In the first embodiment, the waste toner inlet portion 32 is provided above the waste toner reservoir 31 to increase the size (capacity) of the waste toner container 30 and to expand the replacement cycle of the waste toner container 30, making full use of the space inside the image forming apparatus 1 except functional areas such as the image forming units 10, the writing unit 6, intermediate transfer belt 17 (intermediate transfer belt unit), and the like.

Additionally, in the first embodiment, for example, a piezoelectric sensor is used as the waste toner detector 55 to detect whether the waste toner container 30 is filled to capacity with waste toner. More specifically, when the waste toner accumulates to the position (height) of the waste toner detector 55 (piezoelectric sensor), the waste toner detector 55 detects the pressure from the waste toner and then can recognize that the amount of the waste toner accumulating in the waste toner inlet portion 32 has become the predetermined amount. Consequently, the waste toner detector 55 can recognize that the waste toner container 30 is filled to capacity or close to capacity.

The conveyance screw 51 serving as the rotary member includes the rotary shaft 51*a* that extends in the width direction indicated by arrows W1 and W2 and a screw portion 51*b* shaped like a bladed spiral winding around the rotary shaft 51*a*. Both axial ends of the conveyance screw 51 are rotatively supported by a casing of the waste toner inlet portion 32 via bearings.

More specifically, as shown in FIGS. 3, 4A, and 5, the cams 52 are provided on either end portion of the rotary shaft 51*a* of the conveyance screw 51 in the width direction indicated by arrows W1 and W2. The cams 52 rotate together with the conveyance screw 51 about the rotary shaft 51*a*. The cams 52 may be integrated with the rotary shaft 51*a* as a single component or separate members from the rotary shaft 51*a*. It is to be noted that the position of the rotary shaft 51*a* that is the center of rotation of the cams 52 is eccentric from the center of a circle of the cams 52 so that the cams 52 can function as "cams" as the conveyance screw 51 rotates. The cams 52 are used to drive the pushing member 41 (first agitator), and the arms 41*b* of the pushing member 41 are hung on the respective cams 52.

The screw portion 51*b* winding around the rotary shaft 51*a* of the conveyance screw 51 extends in the portion except the axial end portions of the rotary shaft 51*a* where the cams 52 are positioned. The screw portion 51*b* is designed to transport the waste toner in directions away from the cams 52. More specifically, referring to FIG. 5, the right side screw portion 51*b* and the left side screw portion 51*b* in FIG. 5 wind in opposite directions from an axial center portion around the rotary shaft 51*a*. When a motor 102 (shown in FIG. 5), provided outside the waste toner container 30 and connected to the rotary shaft 51*a* of the conveyance screw 51, drives the conveyance screw 51 to rotate in a predetermined direction, the conveyance screw 51 transports the waste toner in the directions away from the cams 52 toward the center portion in the width direction as indicated by arrows W1 and W2 shown in FIG. 5.

By contrast, the pushing member 41 includes the planar portion 41*a* provided inside the waste toner reservoir 31 and the arms 41*b* connected to either end portion in the width direction (indicated by arrows W1 and W2) of the planar portion 41*a*. Further, the positions where the arms 46*b* are connected to the planar portion 41*a* is an end portion on the proximal side in the depth direction indicated by arrow D shown in FIG. 6, that is, the side close to the waste toner inlet portion 32.

As shown in FIG. 4B, the planar portion 41*a* of the pushing member 41 is substantially grid-shaped. More specifically, when viewed from above or below, multiple rectangular penetration holes are arranged vertically and horizontally in the planar portion 41*a* like lacework as shown in FIG. 4B. It is to be noted that the term "grid-shaped" used in this specification includes, in addition to an arrangement in which multiple rectangular penetration holes are regularly arranged in a matrix, arrangements in which multiple penetration holes (not limited to rectangular shapes) are arranged at random.

Additionally, each arm 41*b* of the pushing member 41 includes a U-shaped end portion that is draped over and hangs onto the cam 52 of the conveyance screw 51 like a hook. With this configuration, the contact portion between the arm 41*b* and the cam 52 serves as a drive transmission unit to transmit a drive force of the conveyance screw 51 to the pushing member 41. In other words, the pushing member 41 receives the drive force via the contact portion, serving as the drive transmission unit, from the conveyance screw 51 and swings in conjunction with rotation of the conveyance screw 51 with the planar portion 41*a* changing its inclination relative to the depth direction indicated by arrow D shown in FIG. 6. More specifically, referring to FIG. 6, as the cams 52 rotate eccentrically about the rotary shaft 51*a*, the planar portion 41*a* connected to the arms 41*b* moves vertically as indicated by broken lines and slides in the depth direction. That is, the planar portion 41*a* swings while changing its position in the depth direction as well as its inclination to the depth direction. While moving as described above, the grid-shaped planar portion 41*a* of the pushing member 41 gradually pushes the waste toner accumulating beneath the waste toner inlet portion 32 to the distal side in the depth direction (in FIG. 6, from the left to the right). Thus, the waste toner can be contained in the entire waste toner reservoir 31 extending in the depth direction of the image forming apparatus 1, filling the space therein to its capacity.

In the waste toner container 30 according to the first embodiment, the pushing member 41 is driven in conjunction with driving of the conveyance screw 51 as described above. Further, the drive transmission unit (contact portions between the arms 41*b* and the cams 52) to transmit the drive force from the conveyance screw 51 to the pushing member 41 is positioned outside the waste toner reservoir 31. That is, the drive transmission unit is positioned in both end portions of the waste toner inlet portion 32 in the width direction.

With this arrangement, the waste toner accumulating in the waste toner reservoir 31 is less likely to adhere to the drive connection portion (drive transmission unit) between the pushing member 41 and the conveyance screw 51. Therefore, the pushing member 41 can be driven reliably in conjunction with driving of the conveyance screw 51, preventing or reducing malfunction of the pushing member 41. As a result, the large-capacity waste toner container 30 can be filled with the waste toner entirely.

In particular, in the first embodiment, the waste toner detector 55 is provided in the center portion in the width direction in the waste toner inlet portion 32 to detect whether the waste toner container 30 is filled to capacity with waste toner. Additionally, the cams 52 provided on the conveyance screw 51 are positioned in either end portion in the width direction in the waste toner inlet portion 32, outside the five inlets 32*a*Y, 32*a*M, 32*a*C, 32*a*BK, and 32*a*T in the width direction. Additionally, the screw portion 51*b* of the conveyance screw 51 is designed to transport the waste toner flowing through the five inlets 32*a*Y, 32*a*M, 32*a*C, 32*a*BK, and 32*a*T toward the waste toner detector 55, that is, the center portion in the width direction.

With this configuration, the waste toner flowing to the waste toner inlet portion 32 is less likely to come in direct contact with the cams 52 (or the drive connection portions to transmit the drive force to the arms 41*b*), securing prevention of malfunction of the pushing member 41.

Further, in the first embodiment, the waste toner detector 55 is positioned beneath the conveyance screw 51 inside the waste toner inlet portion 32 as shown in FIG. 3. With this arrangement, the waste toner detector 55 can consider the waste toner container 30 to be filled with waste toner before the waste toner accumulating in the waste toner inlet portion 32 reaches the conveyance screw 51. Therefore, when the waste toner container 30 is actually filled to capacity with waste toner, the waste toner detector 55 does not fail to detect it. Moreover, the waste toner accumulating in the waste toner inlet portion 32 can be prevented from adhering to the cams 52 (or the drive connection portions to transmit the drive force to the arms 41*b*) directly.

Further, referring to FIG. 5, the distance from the inlet 32*a*BK or 32*a*T to the waste toner detector 55 in the width direction is greater than the distance from the inlet 32*a*Y, 32*a*M, or 32*a*C to the waste toner detector 55 in the width direction. Black and white images are generally, printed more frequently than multicolor images or other single color images, and four single-color images are superimposed on the intermediate transfer belt 17. Therefore, the amount of waste toner flowing from the inlet 32*a*BK and that from the inlet 32*a*T are greater than the amount of waste toner flowing from the inlet 32*a*Y, 32*a*M, or 32*a*C. If the inlets 32*a*BK and 32*a*T are positioned close to the waste toner detector 55 or the center portion in the width direction, the level of the waste toner in the end portions might be lower than that in the center portion in the width direction. Such an inconvenience, however, can be restricted when the inlets 32*a*BK and 32*a*T at which the amount of waste toner is greater are positioned farther from the waste toner detector 55, that is, in either end portion in the width direction. In such a configuration, the waste toner accumulating in the waste toner inlet portion 32 can be leveled uniformly in the width direction. Therefore, the waste toner detector 55 can be prevented from erroneously recognizing that the waste toner container 30 is filled to capacity with waste toner before the waste toner container 30 is actually filled to capacity with waste toner.

Figure 7:
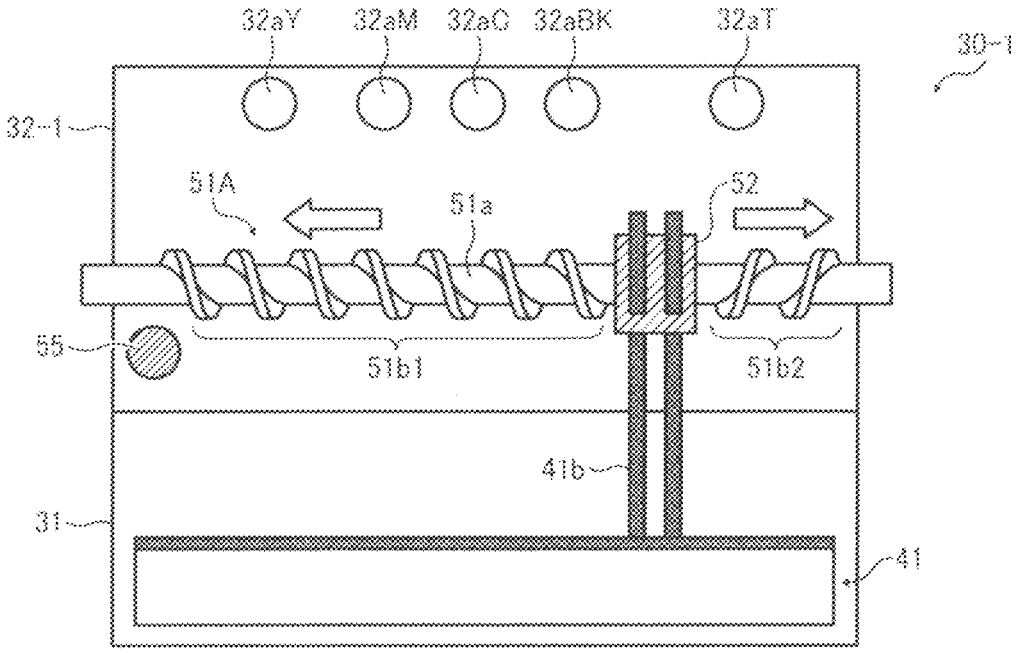
FIG. 7 is a cross-sectional view of another configuration of the waste toner container along a width direction.

It is to be noted that, in the first embodiment, the waste toner detector 55 is provided in the center portion and the cams 52 are provided in the end portions in the width direction in the waste toner inlet portion 32. Alternatively, the waste toner detector 55 and the cams 52 may be arranged differently as shown in FIG. 7, which illustrates a waste toner container 30-1 as a variation of the first embodiment. As shown in FIG. 7, the waste toner detector 55 may be provided in an end portion and a cam 52 may be provided closer to a center portion in the width direction in a waste toner inlet portion 32-1. In the waste toner container 30-1 shown in FIG. 7, a conveyance screw 51A includes a left screw portion 51*b*1 and a right screw portion 51*b*2, respectively provided on the left and right of the cam 52. In this configuration, the left and right screw portions 51*b*1 and 51*b*2 of the conveyance screw 51A are designed to transport the waste toner flowing from the five inlets 32*a*Y, 32*a*M, 32*a*C, 32*a*BK, and 32*a*T away from the cam 52 and to transport the waste toner flowing from at least one of the five inlets 32*a* (in FIG. 7, four inlets 32*a*Y, 32*a*M, 32*a*C, and 32*a*BK) toward the waste toner detector 55 (to the left in FIG. 7). In other words, the screw portion 51*b*2 on the right of the cam 52 in the width direction transports the waste toner collected from the intermediate transfer belt 17, flowing from the inlet 32*a*T, to the right in FIG. 7. By contrast, the screw portion 51*b*1 on the left of the cam 52 transports the waste toner flowing from the four inlets 32*a*Y, 32*a*M, 32*a*C, and 32*a*BK to the left in FIG. 7 on which the waste toner detector 55 is provided.

Also in this configuration, the waste toner flowing to the waste toner inlet portion 32-1 is less likely to come in direct contact with the cam 52 (or the drive connection portion to transmit the drive force to the arm 41*b*), securing reliable operation of the pushing member 41.

As described above, in the waste toner container 30 according to the first embodiment, the pushing member 41 provided in the waste toner reservoir 31 is driven in conjunction with driving of the conveyance screw 51 provided in the waste toner inlet portion 32 positioned above the waste toner reservoir 31. Further, the drive transmission unit (the arms 41*b* and the cams 52) is positioned outside the waste toner reservoir 31. With this arrangement, malfunction of the pushing member 41 can be prevented, and the waste toner can be contained in the entire large-capacity waste toner container 30.

(Second Embodiment)

Figure 8:
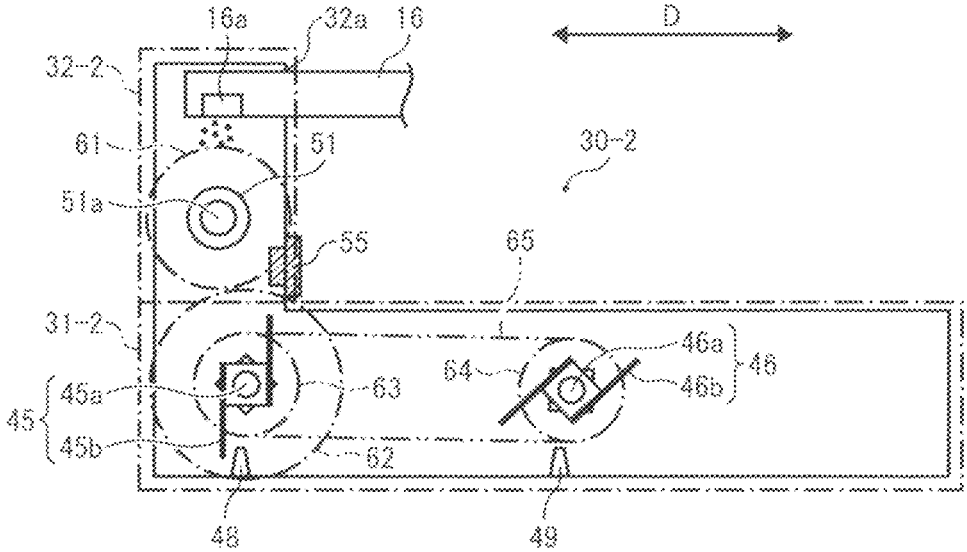
FIG. 8 illustrates a waste toner container according to another illustrative embodiment.
Figure 9A:
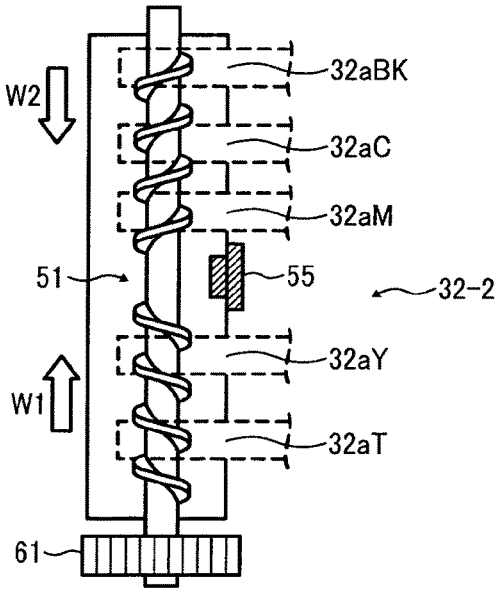
FIGS. 9A and 9B are respectively top views of a waste toner inlet portion and a waste toner reservoir of the waste toner container shown in FIG. 8.
Figure 9B:
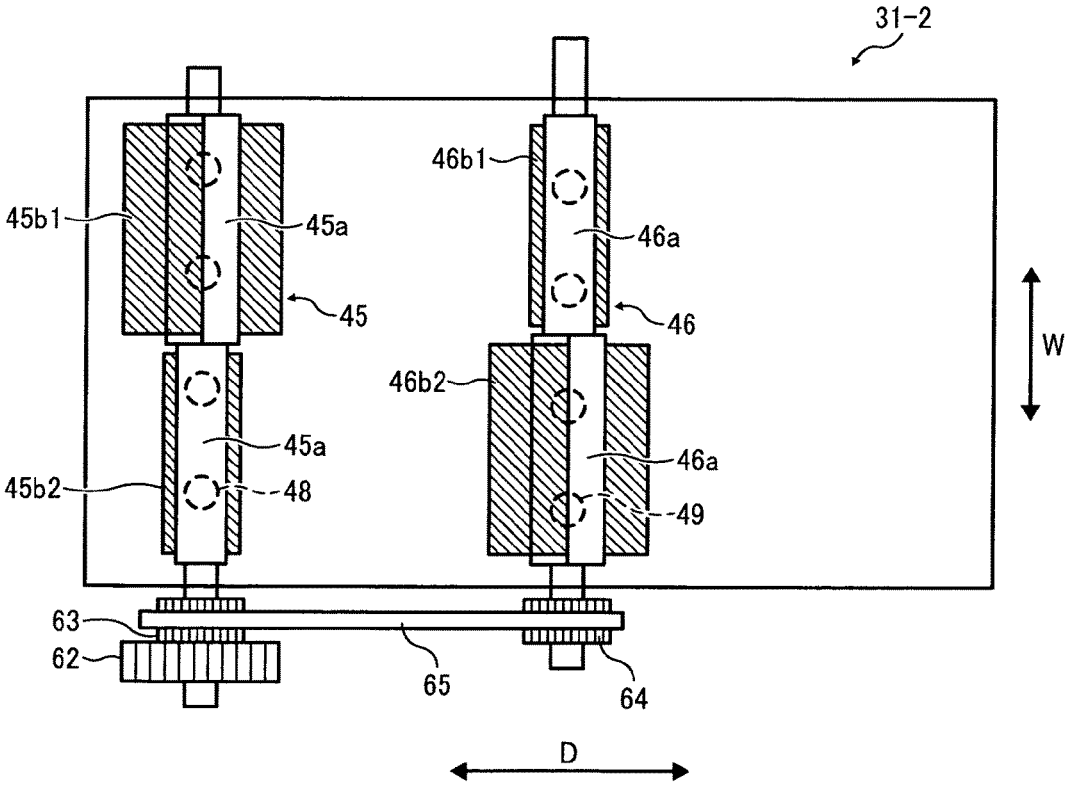

Referring to FIGS. 8, 9A, and 9B, a waste toner container 30-2 according to a second embodiment is described below.

FIG. 8 is a cross-sectional view of the waste toner container 30-2 according to the second embodiment and corresponds to FIG. 3 in the first embodiment. FIG. 9A is a top view of a waste toner inlet portion 32-2 of the waste toner container 30-2, and FIG. 9B is a top view of a waste toner reservoir 31-2 of the waste toner container 30-2. FIGS. 9A and 9B correspond to FIGS. 4A and 4B in the first embodiment, respectively.

The waste toner container 30-2 in the present embodiment is different in that two agitators, namely, first and second agitators 45 and 46, are used from the first embodiment in which the pushing member 41 is used as a single agitator.

Referring to FIGS. 8, 9A, and 9B, similarly to the first embodiment, the waste toner container 30-2 includes the waste toner reservoir 31-2 and the waste toner inlet portion 32-2. A conveyance screw 51 serving as a rotary member is provided in the waste toner inlet portion 32-2. It is to be noted that a gear 61 is provided on an end portion of the rotary shaft 51*a* of the conveyance screw 51 in the width direction, indicated by arrows W1 and W2, of the waste toner container 30-2, outside the waste toner inlet portion 32-2. As the motor 102 (shown in FIG. 5) drives the conveyance screw 51, the screw portion 51*b* transports the waste toner in the directions indicated by arrows W1 and W2, and the gear 61 rotates together with the conveyance screw 51.

Differently from the first embodiment, the first and second agitators 45 and 46 are provided in the waste toner reservoir 31-2 instead of the pushing member 41.

More specifically, the first and second agitators 45 and 46 include prismatic rotary shafts 45*a* and 46*a* and blades 45*b* and 46*b*, respectively. It is to be noted that reference characters 45*b*1 and 46*b*1 represent the blades 45*b* and 46*b* on one side in the width direction indicated by arrow W, and reference characters 45*b*2 and 46*b*2 represent the blades 45*b* and 46*b* on the other side in the width direction. A drive transmission unit to which a drive force is transmitted from the gear 61 directly or indirectly is provided in an axial end portion of the first agitators 45, positioned in the end portion in the width direction, indicated by arrows W1 and W2, of the waste toner container 30-2, outside the waste toner reservoir 31-2.

More specifically, a driven gear 62 that engages the gear 62 is provided on the rotary shaft 45*a* of the first agitator 45 in the end portion in the width direction of the waste toner container 30-2, outside the waste toner reservoir 31-2 and serves as the drive connection portion or drive transmission portion. Additionally, a pulley 63 is also provided on the rotary shaft 45*a* of the first agitator 45 in the end portion in the width direction of the waste toner container 30-2, outside the waste toner reservoir 31-2.

By contrast, a pulley 64 is provided on the rotary shaft 46*a* of the second agitator 46 positioned in a center portion in the depth direction, indicated by arrow D, of the waste toner reservoir 31-2. The pulley 64 is positioned in the end portion in the width direction of the waste toner container 30-2, outside the waste toner reservoir 31-2 similarly. These pulleys 63 and 64 and a timing belt 65 stretched around the pulleys 63 and 64 function as the drive connection portion. That is, the drive force from the conveyance screw 51 is transmitted via the gear 61, the driven gear 62, the pulley 63, the timing belt 65, and the pulley 64 to the rotary shaft 46*a* of the second agitator 46.

Additionally, the blades 45*a* and 46*a* each having a predetermined width in a direction perpendicular to a rotational direction of the rotary shafts 45*a* and 46*a* are provided around the rotary shafts 45*a* and 46*a* of the first and second agitators 45 and 46. For example, each of the blades 45*a* and 46*a* is formed of flexible material, such as plastic sheet, and flips and transports the waste toner accumulating adjacent thereto to the distal side in the depth direction (to the right in FIG. 8) while rotating counterclockwise in FIG. 8. Examples of the material of the blades 45*a* and 46*a* include Mylar®.

That is, receiving the drive force via the drive transmission unit (61 to 65), the first and second agitators 45 and 46 rotate in conjunction with the conveyance screw 51 (rotary member), and thus the blades 45*b* and 46*b* rotate together with the rotary shafts 45*a* and 46*a*, respectively. With this configuration, the waste toner can be flipped from the proximal side to the distal side in the depth direction, and the waste toner can be distributed uniformly in the entire waste toner reservoir 31-2 extending in the depth direction.

It is to be noted that, in the second embodiment, the rotational phases, relative to the rotary shaft 45*a*, of the blades 45*b*1 positioned on one side in the width direction indicated by arrow W are shifted from those of the blades 45*b*2 positioned on the other side in the width direction as shown in FIG. 9B. Similarly, rotational phases, relative to the rotary shaft 46*a*, of the blades 46*b*1 positioned on one side in the width direction are shifted from those of the blades 46*b*2 positioned on the other side in the width direction as shown in FIG. 9B. This configuration can reduce fluctuations in the driving torque when the first and second agitators 45 and 46 are rotated.

As described above, also in the waste toner container 30-2 according to the second embodiment, the first and second agitators 45 and 46 are driven in conjunction with driving of the conveyance screw 51 (rotary member). Further, the drive transmission unit (61 to 65) to transmit the drive force from the conveyance screw 51 to the first and second agitators 45 and 46 is positioned outside the waste toner reservoir 31-2 and outside the waste toner inlet portion 32-2.

With this arrangement, the waste toner accumulating in the waste toner reservoir 32-2 is less likely to adhere to the drive connection portion (drive transmission portion) between the first and second agitators 45 and 46 and the conveyance screw 51. Therefore, the first and second agitators 45 and 46 can be driven reliably in conjunction with driving of the conveyance screw 51, reducing malfunction of the first and second agitators 45 and 46. As a result, the large-capacity waste toner container 30-2 can be filled with the waste toner entirely.

Further, in the second embodiment, projections 48 and 49 are formed in a bottom portion (e.g., an inner bottom surface) of the waste toner reservoir 31-2 at positions corresponding to the first and second agitators 45 and 46. The blades 45*b* and 46*b* come in contact with the projections 48 and 49 in accordance with their rotational cycles and elastically deform temporarily. Because the deformed blades 45*a* and 46*a* return to their original shapes when passing over the projections 48 and 49, the force of the blades 45*b* and 46*b* for flipping off and transporting the waste toner can be increased due to the resilience of the blades 45*b* and 46*b*.

As described above, in the waste toner container 30-2 according to the second embodiment, the first and second agitators 45 and 46 provided in the waste toner reservoir 31-2 is driven in conjunction with driving of the conveyance screw 51 provided in the waste toner inlet portion 32-2 positioned above the waste toner reservoir 31-2. Further, the drive transmission unit (61 to 65) is positioned outside the waste toner reservoir 31-2. With this arrangement, malfunction of the first and second agitators 45 and 46 can be prevented, and the waste toner can be contained in the entire large-capacity waste toner container 30-2.

In the above-described embodiments, the respective components (i.e., the photoreceptor drum 11, the charging roller 12, the development device 13, and the cleaning unit 15) of the image forming unit are housed in a common unit casing as the process cartridge 10 to make the image forming unit compact and to facilitate maintenance work. Alternatively, not all but two or more of these components may be housed in a common unit casing as the process cartridge 10. It is to be noted that it is not necessary to unit the photoreceptor drum 11, the charging roller 12, the development device 13, and the cleaning unit 15 as a single unit and may be installed in the main body so as to be replaced separately. In such a configuration, similar effects can be attained as well.

Additionally, although the description above concerns the image forming apparatus including the two-component development device 13 using two-component developer, the features of the above-described embodiments can adapt to image forming apparatuses including one-component development devices using one-component developer.

Further, although the description above concerns the waste toner container 30 in which the five inlets 32*a*Y, 32*a*M, 32*a*C, 32*a*BK, and 32*a*T are formed, the number of the waste toner inlets is not limited to five. In such a configuration, similar effects can be attained as well.

Moreover, as the rotary member, the conveyance screw 51 including the rotary shaft 51*a* extending in the width direction of the waste toner container 30 and the screw portion 51*b* formed around the rotary shaft 51*a* is used in the above-described embodiments. Alternatively, the rotary member may be simply a rotary shaft extending in the width direction without a screw portion. With such a rotary member without the screw portion, the agitator or agitators provided in the waste toner reservoir 31 can be driven in conjunction with rotation of the rotary member provided in the waste toner inlet portion 32 positioned above the waste toner reservoir 31. The drive transmission unit between the agitator (or agitators) and the rotary member is positioned outside the waste toner reservoir 31, and similar effects can be attained.

Numerous additional modifications and variations are possible in light of the above teachings. It is therefore to be understood that, within the scope of the appended claims, the disclosure of this patent specification may be practiced otherwise than as specifically described herein. The number, position, shape of the components of the image forming apparatus described above are not limited to those described above.

What is claimed is:

1. A waste toner container used in an image forming apparatus, comprising:

a waste toner reservoir extending in a depth direction of the image forming apparatus for containing waste toner removed from an image bearer;

an inlet portion provided above the waste toner reservoir, in which at least one waste toner inlet is formed to receive the waste toner flowing to the waste toner reservoir, the inlet portion being shorter than the waste toner reservoir in the depth direction;

a first agitator provided in the waste toner reservoir, to transport the waste toner accumulating in the waste toner reservoir in the depth direction;

a rotary member provided in the inlet portion including a rotary shaft extending in a width direction perpendicular to the depth direction; and a drive transmission unit provided outside the waste toner reservoir, to transmit a drive force from the rotary member provided in the inlet portion to the first agitator provided in the waste toner reservoir and to drive the first agitator in conjunction with rotation of the rotary member.

2. The waste toner container according to claim 1, wherein the rotary member provided in the inlet portion transports the waste toner in the inlet portion in the width direction when the waste toner accumulating in the waste toner container reaches the inlet portion.

3. The waste toner container according to claim 2, wherein the drive transmission unit comprises a first cam provided at a set position in the width direction of the rotary shaft of the rotary member, the rotary member further includes a screw portion positioned except the set position at which the first cam is provided, the screw portion winding around the rotary shaft to transport the waste toner away from the first cam, the first agitator provided in the waste toner reservoir includes a planar portion positioned inside the waste toner reservoir and an arm connected to the planar portion and hung on the first cam, and as the rotary member provided in the inlet portion rotates, the planar portion of the first agitator positioned inside the waste toner reservoir swings, changing a position in the depth direction and an inclination relative to the depth direction.

4. The waste toner container according to claim 3, wherein the planar portion of the first agitator comprises a grid.

5. The waste toner container according to claim 3, further comprising a waste toner detector provided in the inlet portion to detect whether an amount of the accumulating waste toner reaches a set amount in the inlet portion, wherein multiple waste toner inlets are formed in the inlet position, arranged in the width direction.

6. The waste toner container according to claim 5, further comprising a second cam provided on the rotary shaft of the rotary member, wherein the waste toner detector is positioned in a center portion of the inlet portion in the width direction, the first cam and the second cam are positioned on either end portion of the inlet portion in the width direction outside the multiple waste toner inlets in the width direction, and the screw portion of the rotary member includes two opposed threaded portions that flank a center unthreaded portion and wind in opposite directions from the center unthreaded portion to transport the waste toner flowing from the multiple waste toner inlets toward the center portion of the inlet portion in which the waste toner detector is provided.

7. The waste toner container according to claim 5, wherein the waste toner detector is positioned in an end portion of the inlet portion in the width direction, the first cam is positioned in a center portion of the inlet portion in the width direction, and the screw portion of the rotary member is shaped to transport the waste toner flowing from at least one of the multiple waste toner inlets toward the waste toner detector, away from the first cam.

8. The waste toner container according to claim 2, wherein the rotary member further includes a screw portion with threads that wind around the rotary shaft, the first agitator provided in the waste toner reservoir includes a rotary shaft extending in the width direction, and a blade provided on the rotary shaft of the first agitator, the blade extending in a direction perpendicular to a rotational direction of the rotary shaft of the first agitator, the drive transmission unit includes a gear provided outside the inlet portion and in an end portion in the width direction of the rotary shaft of the rotary member, and a drive transmitter positioned outside the waste toner reservoir and attached to an end portion in the width direction of the rotary shaft of the first agitator to transmit a drive force from the gear to the first agitator, and as the rotary member provided in the inlet portion rotates, the blade of the first agitator provided in the waste toner reservoir rotates together with the rotary shaft thereof, receiving the drive force via the gear and the drive transmitter of the drive transmission unit.

9. The waste toner container according to claim 8, further comprising a projection on an inner wall of the waste toner reservoir to contact the blade of the first agitator in accordance with a rotational cycle of the blade, wherein the blade of the first agitator provided in the waste toner reservoir is constructed of a flexible material and elastically deforms temporarily, contacting the projection.

10. The waste toner container according to claim 8, further comprising a second agitator to transport the waste toner in the waste toner reservoir in the depth direction, disposed in parallel to the first agitator in the waste toner reservoir in the depth direction, wherein the second agitator includes a rotary shaft extending in the width direction and a blade provided on the rotary shaft of the second agitator, the blade extending in a direction perpendicular to a rotational direction of the rotary shaft of the second agitator, the waste toner reservoir is longer in the depth direction than the inlet portion and positioned in an end portion in the depth direction, and the first agitator is positioned beneath the inlet portion and the second agitator is positioned in a center portion of the inlet portion in the depth direction.

11. The waste toner container according to claim 10, wherein the drive transmission unit further comprises:

a driven gear connected to the rotary shat of the first agitator, to engage the gear provided on the rotary shaft of the rotary member;

a first pulley connected to the rotary shaft of the first agitator;

a second pulley connected to the rotary shaft of the second agitator; and a timing belt stretched around the first pulley and the second pulley.

12. The waste toner container according to claim 1, further comprising a waste toner detector positioned beneath the rotary member in the inlet portion, to detect whether an amount of the accumulating waste toner reaches a set amount in the inlet portion.

13. The waste toner container according to claim 1, further comprising a waste toner detector provided in the inlet portion to detect whether an amount of the accumulating waste toner reaches a set amount in the inlet portion, wherein multiple waste toner inlets are formed in the inlet position, arranged in the width direction, and the waste toner detector is positioned farther in the width direction from one of the multiple waste toner inlets through which a greater amount of waste toner flows than other waste toner inlets.

14. The waste toner container according to claim 2, wherein the drive transmission unit comprises a first cam provided at a set position in the width direction of the rotary shaft of the rotary member, and the rotary member further includes a screw portion positioned except the set position at which the first cam is provided, the screw portion winding around the rotary shaft to transport the waste toner away from the first cam.

15. The waste toner container according to claim 2, wherein the first agitator provided in the waste toner reservoir includes a planar portion positioned inside the waste toner reservoir and an arm connected to the planar portion and hung on the first cam, and as the rotary member provided in the inlet portion rotates, the planar portion of the first agitator positioned inside the waste toner reservoir swings, changing a position in the depth direction and an inclination relative to the depth direction.

16. The waste toner container according to claim 2, wherein the rotary member further includes a screw portion with threads that wind around the rotary shaft, and the first agitator provided in the waste toner reservoir includes a rotary shaft extending in the width direction, and a blade provided on the rotary shaft of the first agitator, the blade extending in a direction perpendicular to a rotational direction of the rotary shaft of the first agitator.

17. The waste toner container according to claim 2, wherein the drive transmission unit includes a gear provided outside the inlet portion and in an end portion in the width direction of the rotary shaft of the rotary member, and a drive transmitter positioned outside the waste toner reservoir and attached to an end portion in the width direction of the rotary shaft of the first agitator to transmit a drive force from the gear to the first agitator, and as the rotary member provided in the inlet portion rotates, the blade of the first agitator provided in the waste toner reservoir rotates together with the rotary shaft thereof, receiving the drive force via the gear and the drive transmitter of the drive transmission unit.

18. An image forming apparatus, comprising:

an image forming unit to form a toner image on an image bearer;

a cleaning unit to remove untransferred toner as waste toner form the image bearer after the toner image is transferred therefrom; and a waste toner container for containing the waste toner discharged from the cleaning unit, the waste toner container including:

a waste toner reservoir extending in a depth direction of the image forming apparatus for containing waste toner removed from an image bearer;

an inlet portion provided above the waste toner reservoir, in which at least one waste toner inlet is formed to receive the waste toner flowing to the waste toner reservoir, the inlet portion being shorter than the waste toner reservoir in the depth direction;

a first agitator provided in the waste toner reservoir, to transport the waste toner accumulating in the waste toner reservoir in the depth direction;

a rotary member provided in the inlet portion including a rotary shaft extending in a width direction perpendicular to the depth direction; and a drive transmission unit provided outside the waste toner reservoir, to transmit a drive force from the rotary member provided in the inlet portion to the first agitator provided in the waste toner reservoir and to drive the first agitator in conjunction with rotation of the rotary member.

19. A waste toner container used in an image forming apparatus, comprising:

a waste toner reservoir extending in a depth direction of the image forming apparatus for containing waste toner removed from an image bearer;

an inlet portion provided above the waste toner reservoir, in which at least one waste toner inlet is formed to receive the waste toner flowing to the waste toner reservoir;

a first agitator provided in the waste toner reservoir, to transport the waste toner accumulating in the waste toner reservoir in the depth direction;

a rotary member provided in the inlet portion including a rotary shaft extending in a width direction perpendicular to the depth direction;

a drive transmission unit provided outside the waste toner reservoir, to transmit a drive force from the rotary member provided in the inlet portion to the first agitator provided in the waste toner reservoir and to drive the first agitator in conjunction with rotation of the rotary member; and a waste toner detector provided in the inlet portion to detect whether an amount of the accumulating waste toner reaches a set amount in the inlet portion, wherein multiple waste toner inlets are formed in the inlet position, arranged in the width direction, and the waste toner detector is positioned farther in the width direction from one of the multiple waste toner inlets through which a greater amount of waste toner flows than other waste toner inlets.

* * * * *